US007688986B2

(12) United States Patent
Ito et al.

(10) Patent No.: US 7,688,986 B2
(45) Date of Patent: Mar. 30, 2010

(54) LOUDSPEAKER SYSTEM

(75) Inventors: Atsuko Ito, Hamamatsu (JP); Akira Miki, Hamamatsu (JP); Shinichi Sawara, Kosai (JP)

(73) Assignee: Yamaha Corporation, Hamamatsu-shi (JP)

( * ) Notice: Subject to any disclaimer, the term of this patent is extended or adjusted under 35 U.S.C. 154(b) by 735 days.

(21) Appl. No.: 11/642,231

(22) Filed: Dec. 20, 2006

(65) Prior Publication Data

US 2007/0160240 A1 Jul. 12, 2007

(30) Foreign Application Priority Data

Dec. 21, 2005 (JP) ..... 2005-367553

(51) Int. Cl.
*H04R 3/00* (2006.01)
*H04R 1/02* (2006.01)

(52) U.S. Cl. ..... 381/95; 381/91; 381/110; 381/122

(58) Field of Classification Search ..... 381/56–59, 381/91, 92, 95, 96, 102, 110, 113, 122, 123
See application file for complete search history.

(56) References Cited

U.S. PATENT DOCUMENTS 5,398,287 A * 3/1995 Nuijten ..... 381/96
5,404,397 A * 4/1995 Janse et al. ..... 379/202.01
5,764,779 A * 6/1998 Haranishi ..... 381/71.1
6,516,066 B2 * 2/2003 Hayashi ..... 381/92
6,766,025 B1 * 7/2004 Levy et al. ..... 381/96
7,366,308 B1 * 4/2008 Kock ..... 381/92

OTHER PUBLICATIONS

System Manual of Fullsound FS-03 Advanced Teleconference Interface, issued for CTG Audio, pp. 1-17.

* cited by examiner

*Primary Examiner*—Xu Mei
(74) *Attorney, Agent, or Firm*—Pillsbury Winthrop Shaw Pittman LLP

(57) ABSTRACT

A hands-free loudspeaker system which is capable of achieving high-quality voice amplification without requiring a human speaker to move to a microphone or a microphone to be moved to a human speaker. A microphone whose input level has continued to be above a threshold value for not shorter than a predetermined time period is detected, based on input signals from dispersedly arranged microphones. An input signal from the microphone is selected and outputted to each loudspeaker at an output level or with a delay time, according to a location of the loudspeaker. A preset lowest threshold level is initially set to the threshold value, and an input level of the microphone higher than the threshold value is newly set to the same, while when the input level is lower than the threshold value, a lower value is set to the same in a step-by-step manner.

5 Claims, 7 Drawing Sheets

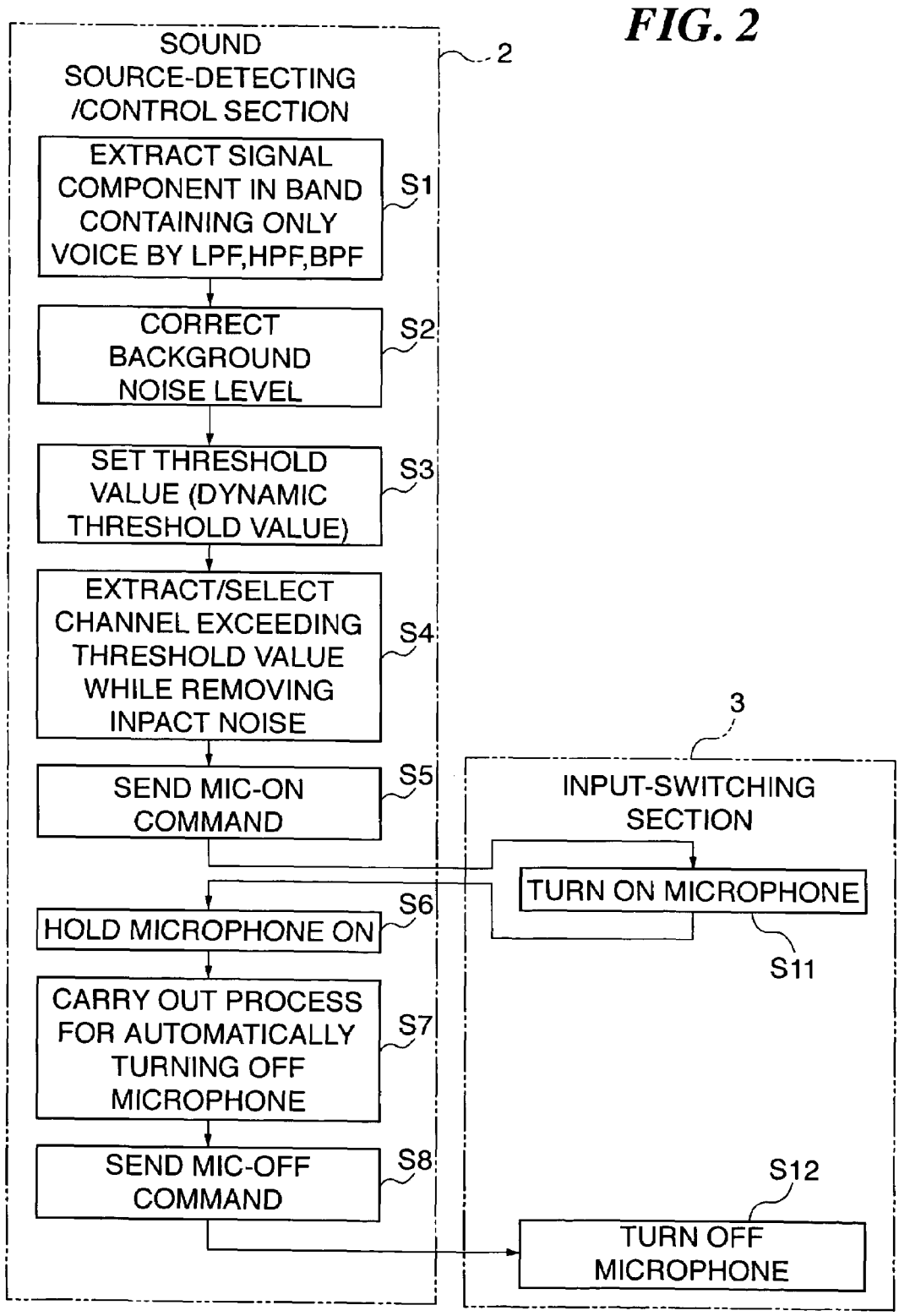
FIG. 2
SOUND SOURCE-DETECTING /CONTROL SECTION
2
EXTRACT SIGNAL COMPONENT IN BAND CONTAINING ONLY VOICE BY LPF,HPF,BPF
S1
CORRECT BACKGROUND NOISE LEVEL
S2
SET THRESHOLD VALUE (DYNAMIC THRESHOLD VALUE)
S3
EXTRACT/SELECT CHANNEL EXCEEDING THRESHOLD VALUE WHILE REMOVING INPACT NOISE
S4
SEND MIC-ON COMMAND
S5
HOLD MICROPHONE ON
S6
CARRY OUT PROCESS FOR AUTOMATICALLY TURNING OFF MICROPHONE
S7
SEND MIC-OFF COMMAND
S8
3
INPUT-SWITCHING SECTION
TURN ON MICROPHONE
S11
S12
TURN OFF MICROPHONE

LOUDSPEAKER SYSTEM

BACKGROUND OF THE INVENTION

1. Field of the Invention

The present invention relates to a loudspeaker system.

2. Description of the Related Art

In the case where a human speaker and an audience are present within the same room having an area or space so large that the human speaker cannot make his/her own voice sufficiently heard by the audience, voice amplification is necessitated.

Conventionally, to carry out voice amplification, a human speaker has to utter voice at a location where a microphone is fixedly set, or otherwise has to carry a microphone, for collection of clear sound. Further, during a question-and-answer session or the like when people present make speeches in turns, each human speaker is required to move to the fixed microphone, or the microphone, not fixed, is required to be moved to the human speaker.

Further, a reproduction system, which is generally comprised of loudspeakers in a centralized arrangement or loudspeakers disposed on a ceiling in a dispersed arrangement, suffers from problems. In the case of the centralized arrangement, voice is amplified more than necessary in the vicinity of the loudspeakers, while in the case of the dispersed arrangement, voice is amplified more than necessary in the vicinity of the human speaker. In short, voice is not uniformly amplified within the same room.

Japanese Laid-Open Patent Publication (Kokai) No. H09-65470 discloses an acoustic system for a temple, for amplifying voice collected by a fixed microphone, using loudspeakers disposed on a ceiling in a dispersed arrangement, wherein the volumes of the respective loudspeakers are set such that they are progressively reduced toward the microphone, to thereby average the volumes of sounds synthesized from the natural voice and voices amplified by the respective loudspeakers.

As described hereinabove, in the conventional loudspeaker system, a human speaker has to speak at a location where a microphone is fixedly set, or otherwise has to carry a microphone, for collection of clear sound. Further, when a plurality of human speakers are present, each human speaker is required to move to the fixed microphone, or the microphone, not fixed, is required to be moved to each human speaker.

In the case where a wired microphone is to be moved, it is necessary to take care of a microphone cable, which troubles a human speaker a lot. On the other hand, as for a wireless microphone, the Radio Law provides that acquisition of a license or registration is required, and the consumer band suffers from the problems of interference and wiretapping (leakage of information).

Further, when a plurality of microphones are provided, it is necessary to manually switch between the microphones, and hence an operator or operators is/are needed from time to time. Furthermore, when a plurality of microphones are used, reduction of a loop gain per system makes it difficult to suppress howling and maintain voice clarity and sound quality.

SUMMARY OF THE INVENTION

It is an object of the present invention to provide a hands-free loudspeaker system which is capable of achieving high-quality voice amplification without requiring a human speaker to move to a microphone or a microphone to be moved to a human speaker.

To attain the above object, the present invention provides a loudspeaker system comprising a plurality of microphones dispersedly arranged in a room, a plurality of loudspeakers dispersedly arranged in the room, a sound source-detecting section that detects a microphone corresponding to a human speaker's location from among the microphones based on input signals from the respective microphones, an input-switching section that selects an input signal from the microphone detected by the sound source-detecting section and outputs the selected input signal, and an output-adjusting section that outputs the signal output from the input-switching section to each of the loudspeakers at an output level or with a delay time, according to a location of the each loudspeaker, wherein the sound source-detecting section detects a microphone whose input level has continued to be above a threshold value for not shorter than a predetermined time period, as the microphone corresponding to the human speaker's location, and wherein a preset lowest threshold level is initially set to the threshold value, and when the input level of the detected microphone is higher than the threshold value, the input level is newly set to the threshold value, while when the input level of the detected microphone is lower than the threshold value, a lower value is set to the threshold value in a step-by-step manner.

According to the loudspeaker system of the present invention, even if a human speaker moves, each of the dispersed arranged microphones is automatically turned by detecting a sound source location, so that the human speaker need not either carry a microphone with him/her or take care of the cord of a wired microphone.

Further, it is possible to suppress interference and variation in a receiving condition, which can often be caused when using a wireless microphone, and prevent leakage of information.

Furthermore, even if a human speaker's location shifts from one place to another e.g. during a question-and-answer session, it is not necessary to manually switch between microphones, which eliminates the need to employ operators.

Moreover, since a microphone closest to the current human speaker's location is selected, the loop gain can be improved, which makes it possible not only to prevent occurrence of howling, but also to ensure voice clarity.

Preferably, after detecting the microphone corresponding to the human speaker's location, the sound source-detecting section does not detect another microphone as the microphone corresponding to the human speaker's location for a predetermined time period.

Preferably, when a state where the input level of the microphone detected by the sound source-detecting section is below the lowest threshold level continues for not shorter than a predetermined time period, the input-switching section causes the input signal of the microphone to be turned off.

Preferably, before comparison is made between the input level of each of the microphones and the threshold value, the sound source-detecting section performs correction on at least one of the input level of each of the microphones and the threshold value based on a background noise level of each of the microphones.

Preferably, the sound source-detecting section detects the microphone corresponding to the human speaker's location based on a signal component of the input signal from each of the respective microphones, in a frequency band in which only human voice level is high.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the present invention and, together with the description, serve to explain the principles of the present invention.

FIG. 2 is a flowchart of a sound source-detecting process executed by a sound source-detecting/control section appearing in FIG. 1;

DETAILED DESCRIPTION OF THE PREFERRED EMBODIMENTS

A preferred embodiment of the present invention will be described in detail below with reference to the drawings.

Figure 1:
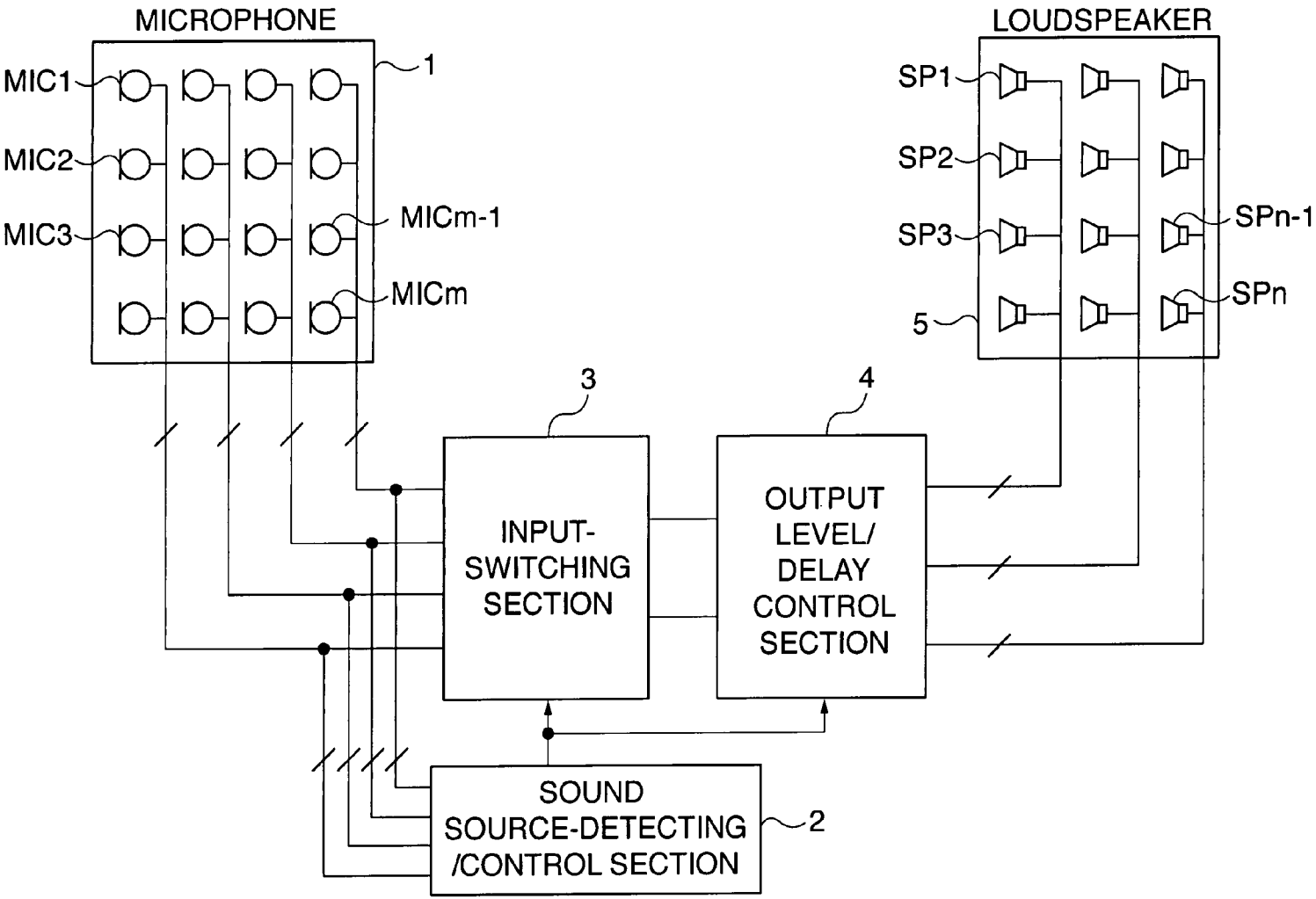
FIG. 1 is a schematic block diagram of a loudspeaker system according to an embodiment of the present invention.

FIG. 1 is a schematic block diagram of a loudspeaker system according to the embodiment of the present invention.

In FIG. 1, reference numeral 1 designates a plurality of (m) microphones dispersedly arranged e.g. on the ceiling of a conference room or a hall where the loudspeaker system of the present invention is installed, and reference numeral 5 designates a plurality of (n) loudspeakers also dispersedly arranged e.g. on the ceiling. Each of the microphones 1 (MIC1 to MICm) has a directivity limited to collect sounds only in an area in the vicinity thereof, and the whole room is covered by the m microphones dispersedly arranged on the ceiling. Similarly, each of the loudspeakers 5 (SP1 to SPn) can be configured to have a directivity limited to output sounds only to an area in the vicinity thereof, and the whole room can be covered by the n loudspeakers dispersedly arranged on the ceiling. It should be noted that space intervals between the microphones 1 and those between the loudspeakers 5 are determined based on the directivities of the microphones 1 and the loudspeakers 5 and the height of the ceiling.

The loudspeakers 5 may be implemented by flat loudspeakers. Further, the loudspeaker may be used as parts of a system ceiling.

Reference numeral 2 designates a sound source-detecting/control section that detects the location of a human speaker (sound source) by monitoring the level of an input signal from each of the microphones (MIC1 to MICm), and then outputs a control signal to an input switching section 3 and an output level/delay control section 4. The input switching section 3 selects an input signal from a microphone MICi corresponding to a location where the human speaker is positioned, based on the control signal from the sound source-detecting/control section 2, and outputs the selected signal. The output level/delay control section 4 performs level control or delay control on the input signal selected by the input switching section 3 in association with each of the loudspeakers 5, based on the control signal from the sound source-detecting/control section 2, and outputs resulting signals to a plurality of power amplifiers, not shown, provided in the respective loudspeakers 5 (SP1 to SPn), respectively.

The sound source-detecting/control section 2 constantly monitors input signals from the respective microphones 1 (MIC1 to MICm), and carries out a sound source-detecting process, described hereinafter with reference to FIG. 2, for detecting a microphone which receives human speaker's voice at a highest voice level.

A microphone MICi whose input level is the highest of all the microphones whose input levels have continued to be above a predetermined threshold value for not shorter than a predetermined time period is detected as a microphone closest to the human speaker (i.e. at a sound source location), and information for turning on the detected microphone is output to the input-switching section 3. In response to this information, the input switching section 3 selects the input signal from the detected microphone and outputs the same to the output level/delay control section 4. Thus, the microphone is turned on.

When the input level of the microphone MICi is lowered, and when another microphone MICj has been receiving an input signal of a level above the predetermined threshold value for not shorter than the predetermined time period, it is judged that the sound source location has been shifted or a new sound source has appeared, and the microphone MICj is detected as a microphone corresponding to the sound source location, and newly turned on.

Further, when the human speaker close to the microphone MICi stopped speaking and no input signal whose level is above the predetermined threshold value has been input to the microphone MICi for a certain time period or longer, it is determined that the sound source corresponding to the location has disappeared, and the microphone MICi is turned off.

Thus, a microphone closest to a human speaker's location is detected from the microphones (MIC1 to MICm) and automatically turned on by the sound source-detecting/control section 2.

The output level/delay control section 4 sets output levels and delay amounts to be applied when the input signal from the microphone selected by the input switching section 3 is output from the respective loudspeakers 5, on a loudspeaker-by-loudspeaker basis.

More specifically, to supply the output signal to each of the loudspeakers 5 (SP1 to SPn) based on the input signal from the microphone MICi which is detected to be at a sound source location and turned on by the input-switching section 2, such that the sound pressure level at a height of listening position becomes uniform anywhere in the room and a voice directly output from the human speaker and amplified voices output from the respective loudspeakers simultaneously reach each listening position, an output level and a delay time (delay amount) to be applied to the output signal is set on a loudspeaker-by-loudspeaker basis.

The output levels to be applied to the signals supplied to the respective loudspeakers are determined such that the sum of the volume of the voice directly output from the human speaker and the volumes of amplified voices output from the respective loudspeakers becomes uniform anywhere in the room. In short, the output signal level of each of the loudspeakers is controlled according to the distance from the sound source location (i.e. the location of the detected microphone) so as to compensate for space attenuation of the direct voice. The level of the output signal supplied to each loudspeaker may be calculated based on the distance between the sound source location and the loudspeaker, or may be determined by referring to a table prepared in advance such that the output levels of each loudspeaker are recorded in association with the respective sound source locations.

The aforementioned delay amount corresponds to a delay time associated with a time period taken for sound directly output from the sound source location to reach each loudspeaker position. By delaying the amplified sound signal to be input to each loudspeaker by the delay time, it is possible to cause the direct sound and the amplified sound to simultaneously reach each associated listening position. The delay time may be calculated based on the distance between the sound source location and each loudspeaker, or may be determined by referring to a table prepared in advance such that delay times associated with the respective loudspeakers are recorded in association with the respective sound source locations.

Thus, a speech made by a human speaker can be heard as a clear and high-quality voice at any listening position in the room.

Although in the above description, the sound source-detecting/control section 2 detects a microphone whose input level is the highest of all the microphones whose input levels have continued to be above the predetermined threshold value for not shorter than the predetermined time period i.e. selects a single microphone, it is also possible to select a plurality of microphones and simultaneously perform voice amplification in a plurality of systems. This makes it possible to cope with the case where a plurality of human speakers utter voices simultaneously, i.e. the case where there are a plurality of sound sources.

Let it be assumed that voice amplification is performed e.g. in two systems. In this case, when the sound source-detecting/control section 2 monitors input signals from the respective microphones (MIC1 to MICm) and detects two microphones whose input levels have continued to be above the predetermined threshold value for not shorter than the predetermined time period, it is determined that sound sources are located at the two microphones MICi and MICj. That is, the two microphones MICi and MICj are detected as microphones at the respective sound source locations. In response to this, the input switching section 3 selects signals from the respective microphones MICi and MICj and outputs these to the output level/delay control section 4.

Similarly to the first-described case, the output level/delay control section 4 controls the levels and delay amounts of output signals supplied to the respective loudspeakers in association with each of the detected microphones such that the sound pressure level becomes uniform anywhere in the room, and then causes each of the loudspeakers to perform voice amplification. In the present example, the output level/delay control section 4, which is configured to be capable of processing input signals in a plurality of systems, controls the levels and delay amounts of output the signals input to each loudspeaker in response to respective input signals from the microphones MICi and MICj, and then adds the output signals in the two systems, followed by outputting the sum of the signals to each of the loudspeakers.

FIG. 2 is a flowchart of a sound source-detecting process executed by the sound source-detecting/control section 2 appearing in FIG. 1.

Referring to FIG. 2, the sound source-detecting/control section 2 repeatedly carries out steps S1 to S4 on input signals from all the microphones MIC1 and MICm at predetermined time intervals (e.g. 10 milliseconds) so as to detect a microphone receiving a human speaker's voice at a higher level than any other microphone, and selects the detected microphone as one at the sound source location.

Specifically, first in a step S1, a signal component in a frequency band containing only human voice is extracted from an input signal from each microphone, using a filter (LPF, HPF, or BPF), and an average of signal levels detected during predetermined time duration (e.g. 10 milliseconds) is determined at corresponding time intervals, and is set to the input signal level of an associated microphone at the time.

More specifically, filtering is performed in a frequency band in which only a level of human voice becomes high, so as to avoid erroneously detecting a microphone by non-voice sound (e.g. noise generated by turning over a page or noise generated by horse shoes) generated in the room, and then level comparison is performed. It should be noted that the above-mentioned frequency band is required to be determined not only based on the human voice level, but also in consideration of the directivity of the microphone in the frequency band. Filtering may be performed in a plurality of frequency bands (e.g. 125 Hz and 4 kHz), and when a sound shows high levels in the respective frequency bands, the sound may be determined to be human voice. Alternatively, filtering may be performed in one or more predetermined frequency bands, and when a sound shows low levels in the respective frequency bands, the sound may be determined to be human voice.

Figure 3:
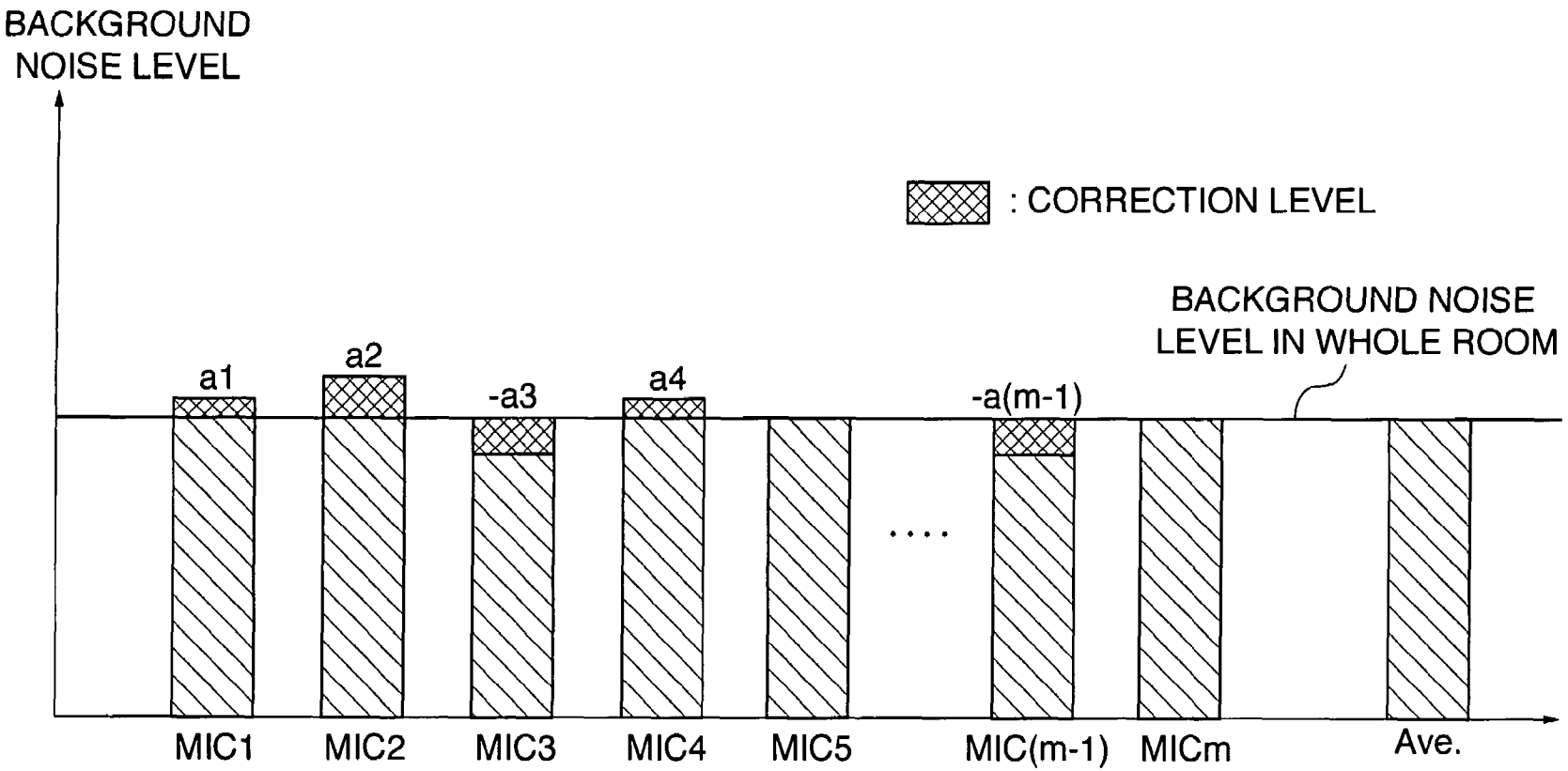
FIG. 3 is a diagram useful in explaining a process for correcting a background noise level, which is executed in a step S2 in FIG. 2.

Next, a process for correcting the background noise level of each microphone is carried out in a step S2 (see FIG. 3).

The level of background noise, such as air-conditioning noise, generated in a room varies with the location of a microphone. Therefore, before sound source detection is started (i.e. before an audience enters the room), not only the level of background noise present in the vicinity of each microphone, but also the background noise level in the whole room (the average value of the background noise levels of all the microphones) are measured in advance. FIG. 3 shows an example of the result of the measurements. Then, the difference between the background noise level of each microphone and the background noise level in the whole room is calculated, and the input level of the associated microphone or a threshold value is corrected by the difference. It should be noted that a background noise level is represented by a value obtained by averaging the energies of signals input to an associated microphone for several seconds.

In the example shown in FIG. 3, the background noise levels of respective microphones MIC1, MIC2, and MIC4 are higher than the background noise level in the whole room by a1, a2, and a4, respectively, and the background noise levels of respective microphones MIC3 and MIC(m−1) are lower than the background noise level in the whole room by a3 and a(m-l), respectively. As for the microphones MIC1, MIC2, and MIC4, therefore, values obtained by subtracting a1, a2, and a4 from their input levels, respectively, are compared with the threshold value, and as for the microphones MIC3 and MIC(m−1), values obtained by adding a3 and a(m−1) to their input levels, respectively, are compared with the threshold value. Alternatively, a threshold value for each of the microphones may be obtained by adding or subtracting a correction level for the associated microphone to/from a reference threshold value.

Thus, the input level of each microphone is compared with the threshold value without being influenced by the background noise level of an associated microphone.

Next, in a step S3, the threshold value to be compared with the input levels is set as follows:

A voice uttered by a human speaker reaches each of the dispersedly arranged microphones with a slight time lag corresponding to distance from the microphone. Since a microphone to be turned on is generally located closest to the human speaker, the human speaker's voice reaches the microphone earliest, and the longer the distance between the human speaker and a microphone is, the longer it takes for the human speaker's voice to reach the microphone. Under the condition, when the human speaker stops speaking for a while, the input level of an adjacent microphone which the voice reaches later can become higher than that of the microphone detected as one at the sound source location (hereinafter simply referred to as "the detected microphone"), which causes erroneous shift of the detected microphone to the adjacent microphone. Hence, it is necessary to prevent occurrence of such an erroneous shift.

To cope with this problem, according to the present embodiment, the threshold value is dynamically changed according to the input level of the detected microphone (i.e. a dynamic threshold value is used), following rules described below.

(1) When there is no detected microphone, the threshold value is set to a lowest threshold level. The lowest threshold level is set to a value sufficiently higher than the background noise level in the room but lower than the level of normal human voice.

(2) When the input level of the detected microphone is lower than the lowest threshold level, the threshold value is set to the lowest threshold level.

(3) When the input level of the detected microphone is higher than the threshold value, the threshold value is set to the input level of the detected microphone after the lapse of a predetermined time period.

(4) When the input level of the detected microphone is lower than the threshold value, the level of the threshold value is lowered by a predetermined level at predetermined update time intervals in a step-by-step manner.

The dynamic threshold value will be described in more detail with reference to FIG. 4.

Figure 4:
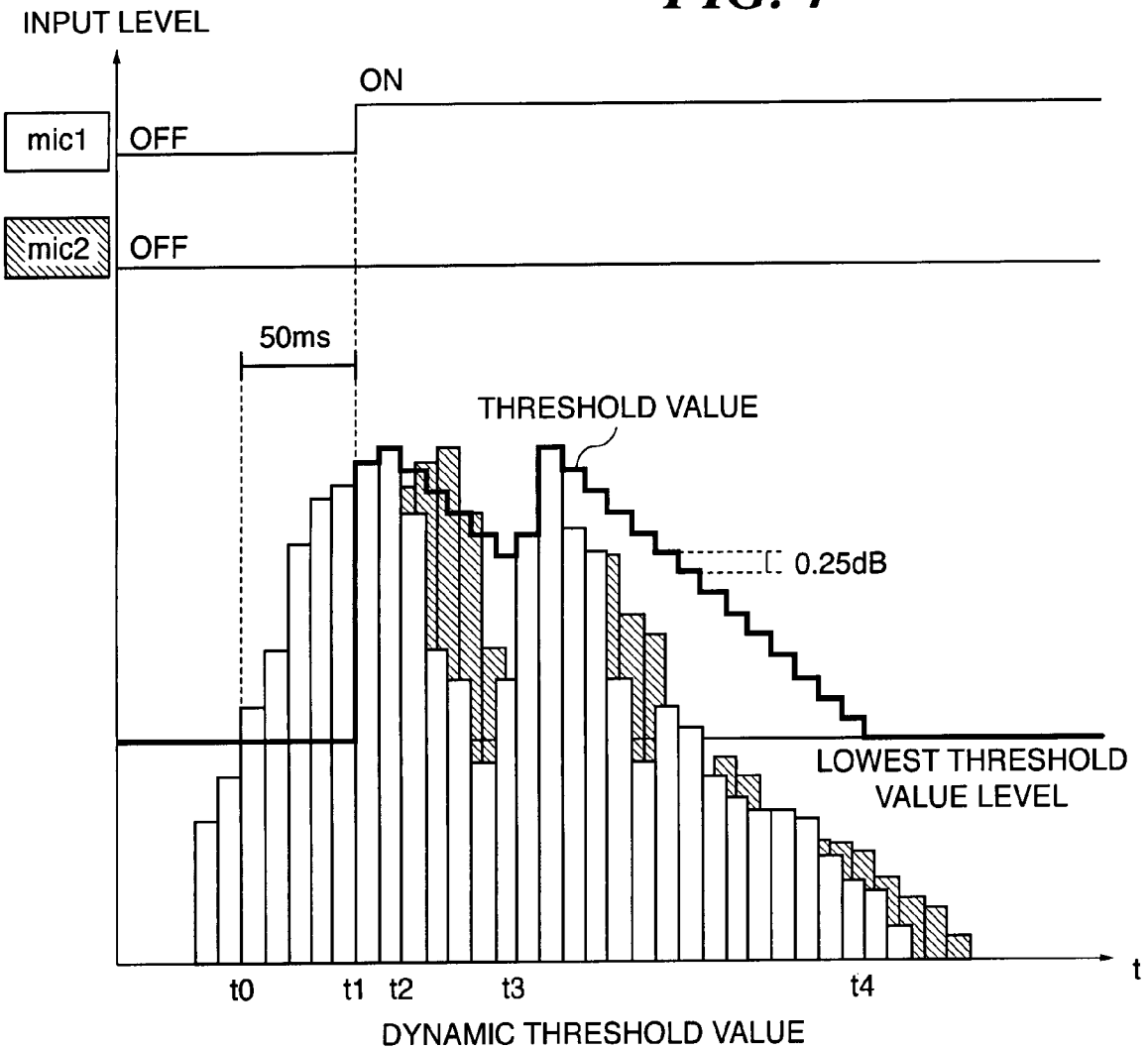
FIG. 4 is a diagram useful in explaining a process (dynamic threshold value process) for dynamically changing a threshold value, which is executed in a step S3 in FIG. 2.

In FIG. 4, a second microphone mic2 is located farther from a sound source than a first microphone mic1, and hence the time axis of the input level of the second microphone mic2 lags behind that of the input level of the first microphone mic1.

At time t0, the input level of the first microphone mic1 is higher than the lowest threshold level.

As described in-detail hereinafter, in order to prevent erroneous detection of a microphone due to influence of impact noise, a microphone is detected to be at a sound source location only when a state where the input level of the microphone has continued to be above the threshold value for not shorter than a predetermined time period (50 milliseconds in the illustrated example).

At time t1, since 50 milliseconds has elapsed after the input level of the first microphone mic1 exceeded the threshold value, the first microphone mic1 is detected to be at a sound source location (i.e. turned on). At this time, the threshold value is set to the input level of the first microphone mic1, following the rule (3). An input level detected during another 10-millisecond time period is compared with this threshold value.

At time t2, the input level of the first microphone mic1 becomes lower than the threshold value, and hence the threshold value is reduced, from this time on, by a predetermined level at predetermined time intervals, following the rule (4). In the illustrated example, the threshold value is reduced by 0.25 dB/10 milliseconds. In the meantime, the input level of the adjacent second microphone mic2 can become higher than that of the first microphone mic1 as shown in FIG. 4, but normally, the input level of the adjacent second microphone mic2 by no means continues to be above the threshold value for a long time period (longer than 50 milliseconds). This is because when there is no input to the first microphone mic1, there is no input, either, which reaches the second microphone mic2 with delay.

At time t3, since the human speaker close to the first microphone mic1 starts speaking again, and the input level of the first microphone mic1 exceeds the threshold value, the threshold value is raised to the input level of the first microphone mic1, following the rule (3).

Thereafter, the input level of the first microphone mic1 continuously becomes lower than the threshold value, and hence the level of the threshold value is continuously lowered by the predetermined level and reaches the lowest threshold level at time t4.

According to the present embodiment, the level of the threshold value is raised according to the input level of a detected microphone, and when the input level of the detected microphone becomes lower than the threshold value, the level of the threshold value is gradually lowered. This makes it possible to prevent a microphone (mic2) adjacent to the detected microphone (mic1) from being detected when input to the detected microphone is stopped for a while.

In a step S4, channels (microphones) whose input levels are higher than the threshold value are extracted while removing the impact noise, and then a microphone whose input level is the highest of all the microphones whose input levels have continued to be above the predetermined threshold value over a predetermined time period is selected.

In the following, removal of the impact noise will be described with reference to FIG. 5.

Figure 5:
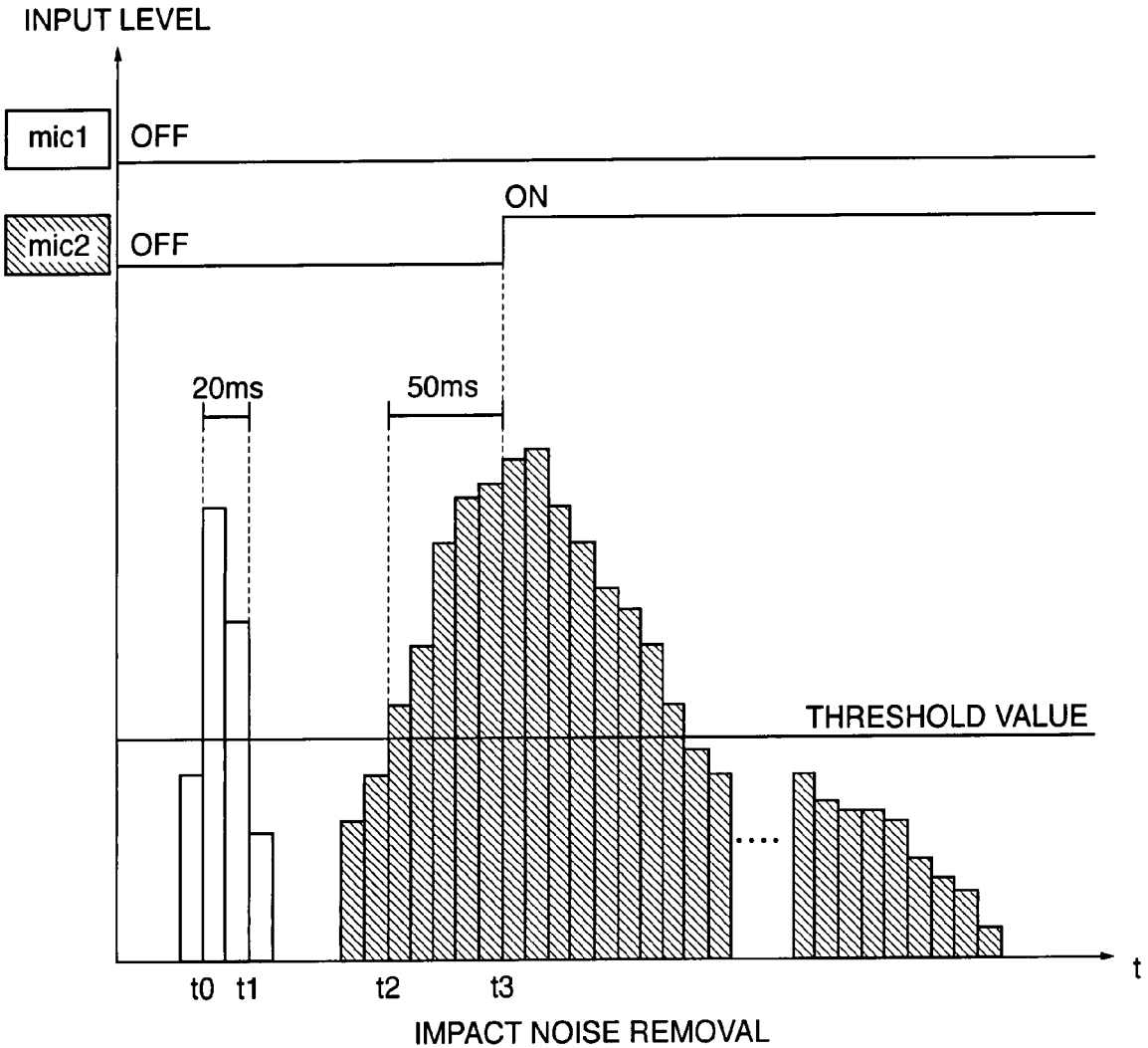
FIG. 5 is a diagram useful in explaining an impact noise removal process, which is executed in a step S4 in FIG. 2.

In FIG. 5, the threshold value is depicted not as a dynamic value, but as a fixed value, for simplicity.

According to the present embodiment, as described hereinbefore, a microphone is turned on only when a state where the input level of the microphone has continued to be above the threshold value for a predetermined time period or longer, so as to prevent erroneous microphone selection or detection due to influence of impact noise.

If the predetermined time period is too short, a detected microphone is switched to another due to influence of various non-voice sounds in the room. On the other hand, if the predetermined time period is too long, the beginning part of a speech is not amplified. In addition to these problems, processing time (approximately 10 milliseconds) taken for the input switching section 3 appearing in FIG. 1 to turn on the microphone is required to be taken into consideration, and it is preferable from an auditory point of view to set a time period from a time point at which a voice is uttered to a time point at which the associated microphone is actually turned on to not longer than 100 milliseconds.

In the example shown in FIG. 5, a microphone is turned on when a state where the input level of the microphone has continued to be above the set threshold value for not shorter than 50 milliseconds. More specifically, the input level of the first microphone mic1 exceeded the threshold value at time t0 and became lower than the threshold value at time t1. In this case, since a time period over which the input level continued to be above the threshold value was 20 milliseconds, i.e. shorter than 50 milliseconds, the microphone mic1 was not turned on. On the other hand, the microphone mic2 was turned on at time t3 because its input level exceeded the threshold value at time t2 and continued to be above the threshold value for more than 50 milliseconds. Thus, erroneous detection of a microphone due to influence of impact noise can be prevented.

The steps S1 to S4 are repeatedly carried out for each of the microphones (mic1 and micm), and a microphone whose input level is the highest of all the microphones whose input levels have been above the predetermined threshold value over the predetermined time period is detected to be at a sound source location. In the case where voice amplification is performed in a plurality of systems (e.g. two systems), a plurality of microphones (e.g. two microphones) whose input levels are the highest are detected as ones at respective sound source locations.

Then, a mic-on (microphone-on) command for turning on the selected microphone is sent to the input-switching section 3 (step S5). In response to this, the input-switching section 3 selects an input signal from the selected microphone and outputs the same to the output level/delay control section 4 to turn on the microphone (step S11).

A microphone closest to a human speaker is thus detected-to be at a sound source location. In the present embodiment, immediately after the detected microphone is turned on, a process for maintaining the ON state of the detected microphone is carried out in a step S6 so as to prevent frequent switching of the detected microphone.

More specifically, once a microphone has been detected, in whatever condition (e.g. even when the input level of another microphone is higher), the detected microphone is held in the ON state during a certain time period (preset microphone-holding time period) even after the input level of the microphone becomes lower than the threshold value.

In the following, the process for maintaining the ON state of the detected microphone will be described with reference to FIG. 6.

Figure 6:
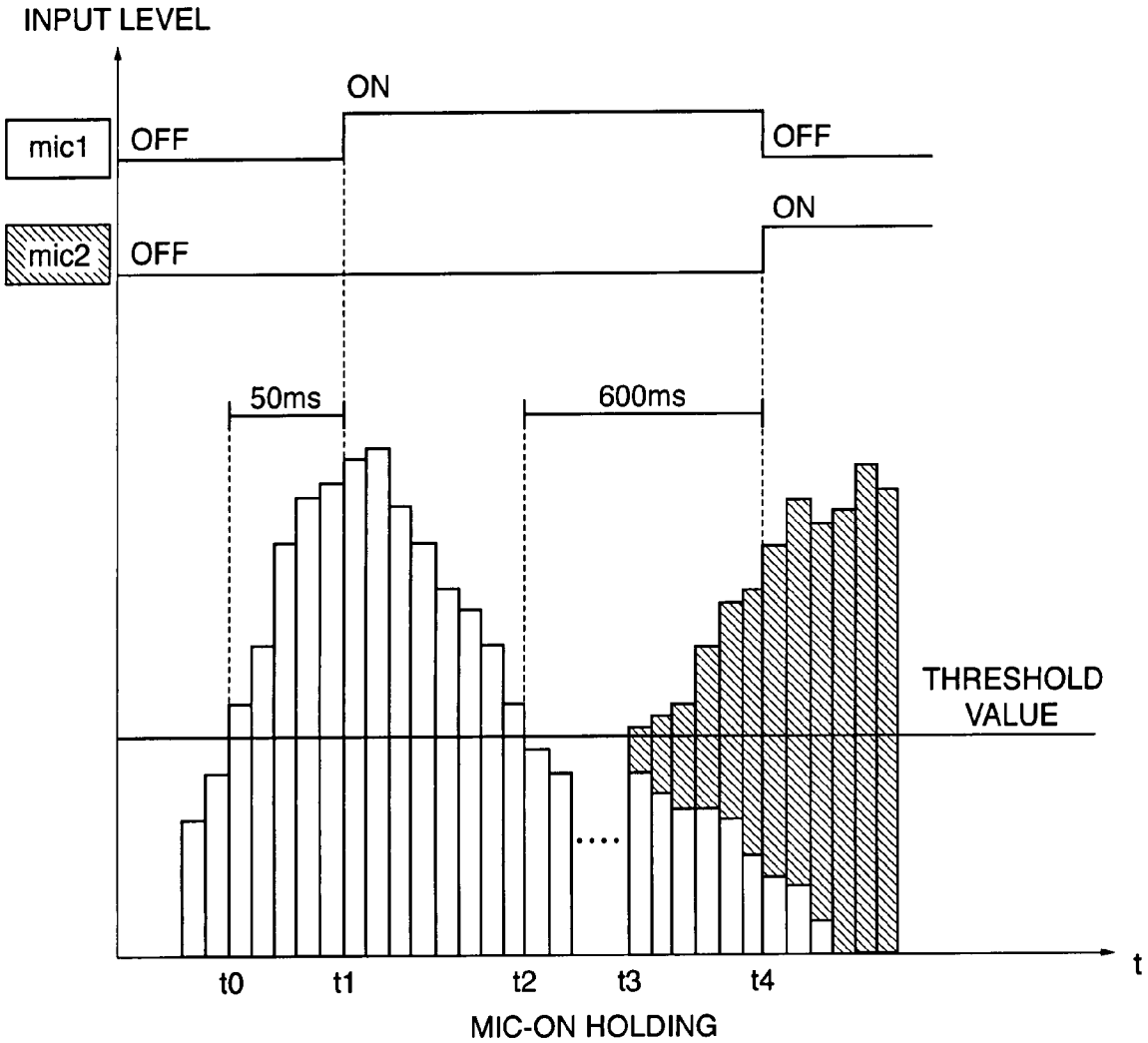
FIG. 6 is a diagram useful in explaining a process for maintaining an ON state of a microphone, which is executed in a step S6 in FIG. 2.

In FIG. 6 the threshold value is also depicted not as a dynamic value, but as a fixed value, for simplicity.

In the illustrated example, the input level of the first microphone mic1 exceeds the threshold value at time t0, and then the state where the input level has continued to be above the threshold value for more than 50 milliseconds, so that the first microphone mic1 is turned on at time t1. Thereafter, the input level of the first microphone mic1 becomes lower than the threshold value at time t2, and this state continues. However, the first microphone mic1 is still held in its ON state. Then, at time 3, the input level of the second microphone mic2 exceeds the threshold value, and then the state where the input level is above the threshold value continues for more than 50 milliseconds. However, the first microphone mic1 is held in its ON state until the preset microphone-holding time period (600 milliseconds in the illustrated example) elapses after the time t2 at which the input level of the first microphone mic1 became lower than the threshold value. At time t4 at which 600 milliseconds has elapsed after the time t2, the second microphone mic2 is turned on, and the first microphone mic1 is turned off.

As described above, once detected, the detected microphone is by no means switched to another microphone during the preset microphone-holding time period even when the input level of the other microphone exceeds the threshold level. Thus, it is possible to prevent frequent switching for the detected microphone from one microphone to another.

It should be noted that the above-described processing can also be applied to voice amplification in a plurality of systems. In this case, when the preset microphone-holding time period (600 milliseconds) has elapsed after the input level of one of a plurality of microphones currently kept on became lower than the threshold level earliest of all the input levels of the microphones, if the input level of any microphone other than the microphones held on has continued to be above the threshold level for not shorter than the predetermined time period (50 milliseconds), the other microphone is turned on in place of the one microphone whose input level became lower than the threshold level earliest.

Further, the sound source-detecting/control section 2 carries out a process for automatically turning off the detected microphone (step S7), so as to prevent only background noise from being amplified after the human speaker stops speaking, and sends a mic-off (microphone-off) command to the input-switching section 3 (step S8). The input-switching section 3 turns off the microphone input in response to the mic-off command (step S12). In other words, signal input to the output level/delay control section 4 is turned off.

In the following, the process-for automatically turning off the detected microphone will be described with reference to FIG. 7.

Figure 7:
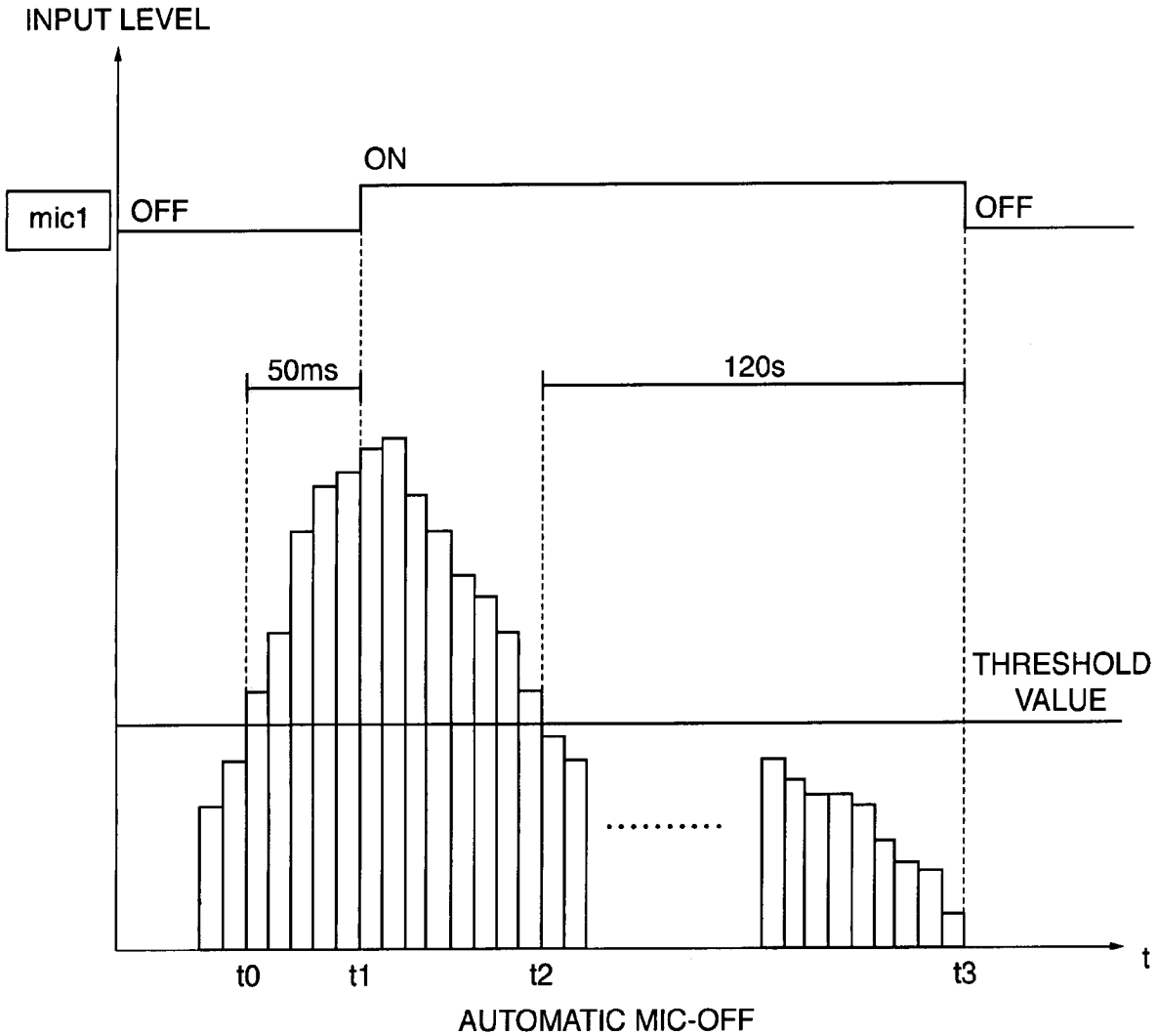
FIG. 7 is a diagram useful in explaining a process for automatically turning off a microphone, which is executed in a step S7 in FIG. 2.

The threshold value is depicted not as a dynamic value, but as a fixed value, for simplicity, in FIG. 7 as well.

In this process, when the detected microphone has not received any input whose level is higher than the lowest threshold level over a predetermined time period (mic-off setting time period), it is judged that no human speaker is there, and the microphone is automatically turned off.

In an example shown in FIG. 7, the input level of the first microphone mic1 exceeds the threshold value at time t0, and then the state where the input level is above the threshold value continues for more than 50 milliseconds, so that the first microphone mic1 is turned on at time t1. Thereafter, the input level of the first microphone mic1 becomes lower than the threshold value at time t2, and then the state where the first microphone mic1 does not receive any input higher than the threshold level continues over the mic-off setting time period (120 seconds in the present example). Therefore, the microphone mic1 is automatically turned off at time t3.

By thus turning off the detected microphone automatically when the predetermined time period elapses after the associated human speaker stops speaking, it is possible to prevent only background noise from being amplified after stoppage of the speech.

As described above, a microphone whose input level is the highest of all the microphones whose input levels have continued to be above a threshold value for not shorter than a predetermined time period (e.g. 50 milliseconds) is detected as a microphone at a sound source location by the sound source-detecting/control section 2. Once the microphone has been detected, even when its input level becomes lower than the threshold value, another microphone cannot be detected before the preset microphone-holding time period (e.g. 600 milliseconds) elapses. When the preset microphone-holding time period elapses after the input level of the detected microphone becomes lower than the threshold value, if there is any other microphone whose input level has continued to be above the threshold level for not shorter than the predetermined time period (50 milliseconds), the microphone is newly detected. If there is no such a microphone, the microphone already detected remains as the detected microphone. When the state where the input level of the detected microphone is below the threshold value continues over the mic-off setting time period (e.g. 120 seconds), the microphone is turned off.

It should be noted that the step S1 for extracting a signal component in a frequency band in which only voice level is high, the step S2 for correcting a background noise level, the step S6 for holding the ON state of the detected microphone, and the step S7 for automatically turning off the detected microphone are not all required to be carried out, but they may be optionally selected and carried out.

Although in the above description, the input level of each microphone is calculated as an average value over each duration of 10 milliseconds at corresponding time intervals, this is not limitative, but it may be calculated at intervals of a different time period. Further, the rate of lowering the threshold level, the predetermined time period for removing impact noise, the preset microphone-holding time period, and the mic-off setting time period are not limited to the above exemplary values, but desired values may be used on a case-by-case basis.

The above-described embodiments are merely exemplary of the present invention, and are not be construed to limit the scope of the present invention.

The scope of the present invention is defined by the scope of the appended claims, and is not limited to. only the specific descriptions in this specification. Furthermore, all modifications and changes belonging to equivalents of the claims are considered to fall within the scope of the present invention.

What is claimed is:

1. A loudspeaker system comprising:

a plurality of microphones dispersedly arranged in a room;

a plurality of loudspeakers dispersedly arranged in the room;

a sound source-detecting section that detects a microphone corresponding to a human speaker's location from among said microphones based on input signals from said respective microphones;

an input-switching section that selects an input signal from said microphone detected by said sound source-detecting section and outputs the selected input signal; and an output-adjusting section that outputs the signal output from said input-switching section to each of said loudspeakers at an output level or with a delay time, according to a location of said each loudspeaker, wherein said sound source-detecting section detects a microphone whose input level has continued to be above a threshold value for not shorter than a predetermined time period, as said microphone corresponding to the human speaker's location, and wherein a preset lowest threshold level is initially set to the threshold value, and when the input level of the detected microphone is higher than the threshold value, the input level is newly set to the threshold value, while when the input level of the detected microphone is lower than the threshold value, a lower value is set to the threshold value in a step-by-step manner.

2. A loudspeaker system as claimed in claim 1, wherein after detecting said microphone corresponding to the human speaker's location, said sound source-detecting section does not detect another microphone as said microphone corresponding to the human speaker's location for a predetermined time period.

3. A loudspeaker system as claimed in claim 1, wherein when a state where the input level of said microphone detected by said sound source-detecting section is below the lowest threshold level continues for not shorter than a predetermined time period, said input-switching section causes the input signal of said microphone to be turned off.

4. A loudspeaker system as claimed in claim 1, wherein before comparison is made between the input level of each of said microphones and the threshold value, said sound source-detecting section performs correction on at least one of the input level of each of said microphones and the threshold value based on a background noise level of each of said microphones.

5. A loudspeaker system as claimed in claim 1, wherein said sound source-detecting section detects said microphone corresponding to the human speaker's location based on a signal component of the input signal from each of said respective microphones, in a frequency band in which only human voice level is high.

* * * * *